United States Patent [19]

Clevenhagen

[11] Patent Number: 4,908,880

[45] Date of Patent: Mar. 20, 1990

[54] BASEBALL GLOVE OR MITT

[75] Inventor: Robert L. Clevenhagen, Ava, Mo.

[73] Assignee: Figgie International Inc., Richmond, Va.

[21] Appl. No.: 182,473

[22] Filed: Apr. 15, 1988

[51] Int. Cl.[4] ..... A41D 13/08

[52] U.S. Cl. ..... 2/19

[58] Field of Search ..... 2/19, 161 A

[56] References Cited

U.S. PATENT DOCUMENTS

| | | | |
|---|---|---|---|
| D. 213,285 | 2/1969 | Khazzam | D2/361 |
| 3,030,629 | 4/1962 | Spohr | 2/19 |
| 3,588,915 | 6/1971 | Latina | 2/19 |
| 3,623,163 | 11/1971 | Latina | 2/19 |
| 3,909,848 | 10/1975 | Bruckman | 2/19 |
| 4,192,018 | 3/1980 | Latina | 2/19 |
| 4,541,126 | 9/1985 | Howard et al. | 2/19 |

FOREIGN PATENT DOCUMENTS

| | | | |
|---|---|---|---|
| 161112 | 2/1955 | Australia | 2/19 |

*Primary Examiner*—Ronald Feldbaum

*Attorney, Agent, or Firm*—Senniger, Powers, Leavitt and Roedel

[57] ABSTRACT

A baseball glove, mitt, or the like having a thumb stall, a finger stall spaced from the thumb stall, and a web secured to and extending between the thumb and finger stalls, the web comprising two outer plies of a flexible material and an inner ply of a resilient material sandwiched between the outer plies. The outer plies have a plurality of aligned openings therein arranged in a pattern to define generally radially extending spokes and concentric generally annular crossmembers in the outer plies, the openings exposing the inner ply of resilient material. Stitching extends along the generally radial spokes and around the concentric generally annular cross members, securing the plies together.

17 Claims, 3 Drawing Sheets

BASEBALL GLOVE OR MITT

BACKGROUND OF THE INVENTION

This invention relates to ball gloves and mitts and in particular to improvements in webs for such gloves and mitts.

A variety of web constructions have been made in an effort to improve control and/or the ability of a glove or mitt to catch balls. Examples of such web constructions are shown in U.S. Pat. Nos. 3,321,771 and 4,192,018, incorporated herein by reference. A particular problem in the design of webs for gloves and mitts is to provide a web that can absorb or dissipate the impact energy from catching a ball. This is important to improving the ability of the glove or mitt to catch and retain the ball as well as to increasing the comfort of the user.

SUMMARY OF THE INVENTION

It is among the objects of the present invention to provide a baseball glove or mitt with a web construction that absorbs at least part of the impact energy from catching a ball, and it is therefore among the objects of the invention to provide such a web that includes a resilient ply to absorb impact energy.

Generally, a baseball glove or mitt constructed according to the principles of the present invention comprises a palm portion, a thumb stall, at least one finger stall, and a web extending between the thumb and finger stalls.

The web comprises at least one flexible ply and a resilient ply. In the preferred embodiment the resilient ply is sandwiched between two outer flexible plies. The outer plies preferably have a plurality of aligned openings therein, exposing the resilient ply. The outer and inner plies are secured together around the periphery of the openings, for example with stitching. When a ball impacts the web, it flexes the flexible outer plies and distorts the openings therein. The distortion of these openings is resisted by the resilient ply that is sandwiched between the outer plies and secured thereto, the resilient ply absorbing at least a portion of the impact force of the ball. The flexible outer plies temper the resilience of the web to prevent the ball from bouncing out of the glove.

In the preferred embodiment the openings in the outer plies are sized and arranged to define a plurality of radially extending spokes with concentric, generally annular cross-members. The cross members preferably comprise a plurality of curved segments, with their concave sides facing radially outwardly.

Thus, gloves or mitts with the web construction of this invention can absorb at least some of the impact energy of a ball. This and other advantages will be in part apparent and in part pointed out hereinafter.

BRIEF DESCRIPTION OF THE DRAWINGS

Corresponding reference numerals indicate corresponding parts throughout the several views of the drawings.

DETAILED DESCRIPTION OF THE PREFERRED EMBODIMENT

Figure 1:
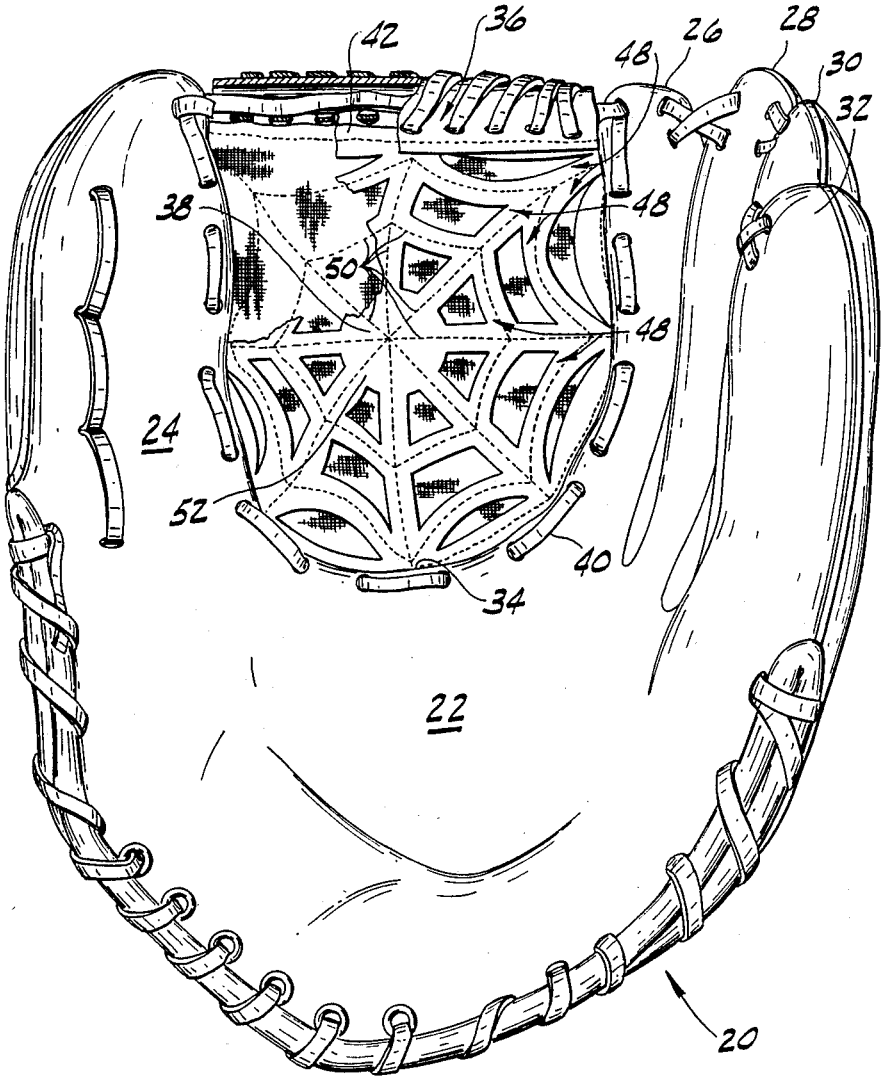
FIG. 1 is a perspective view of a baseball glove constructed according to the principles of this invention, with a portion of the web broken away to show its construction.
Figure 2:
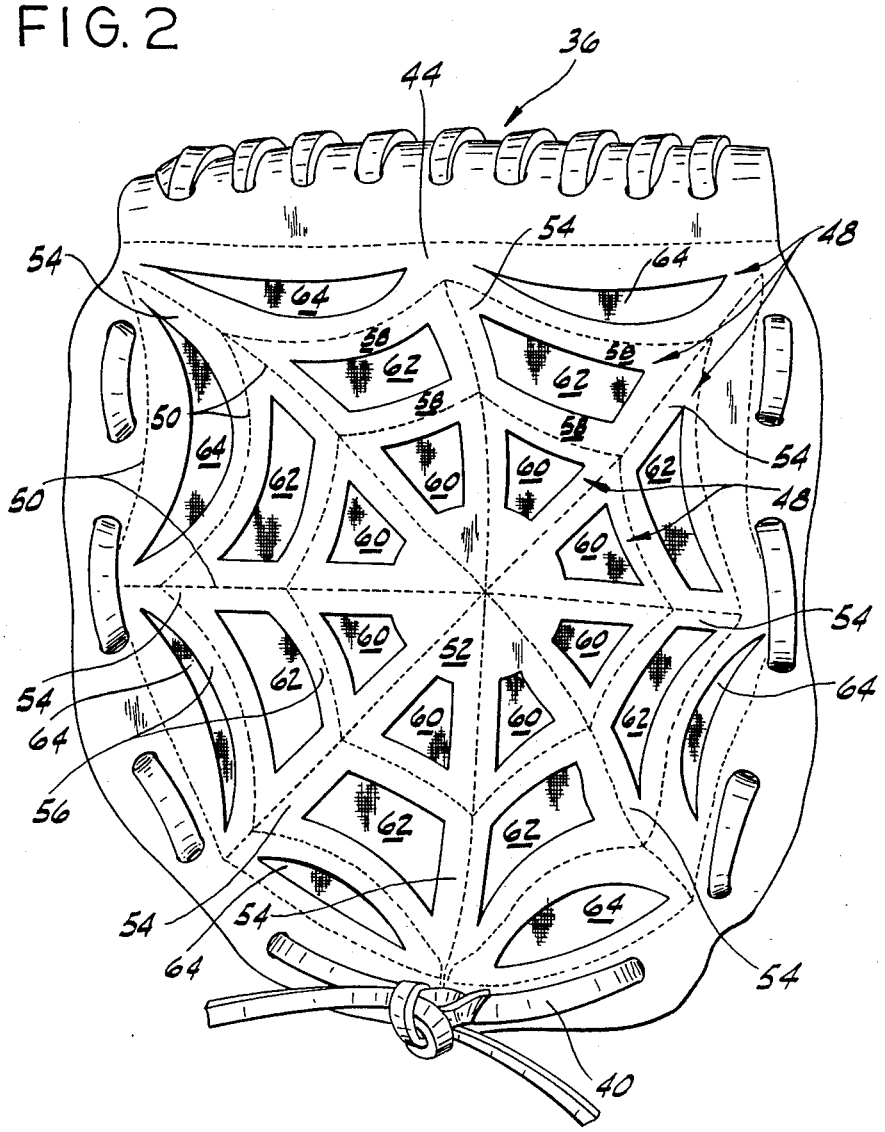
FIG. 2 is a rear elevation view of the web of the glove shown in FIG. 1.
Figure 3:
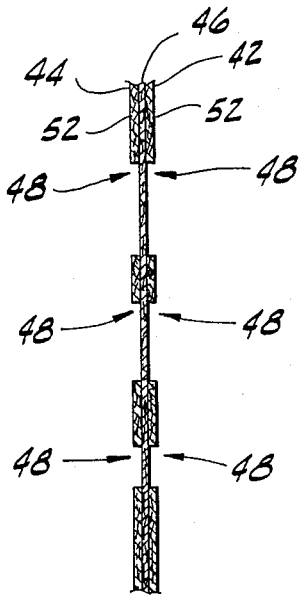
FIG. 3 is a partial cross-sectional view of the web taken along the plane of line 3—3 in FIG. 1.

A baseball glove constructed according to the principles of the present invention is indicated generally as 20 in FIG. 1. While the preferred embodiment of this invention is described with respect to a baseball glove, the invention is not limited to such gloves and may be incorporated into mitts as well. The baseball glove 20 comprises a generally concave palm portion 22, a thumb stall 24 for at least partially receiving the wearer's thumb, and a plurality of finger stalls, 26, 28, 30, and 32, for at least partially receiving the wearer's fingers. Other embodiments of gloves or mitts of this invention may be constructed with fewer than four finger stalls. The portion of the glove between the tuumb stall 24 and the next adjacent finger stall 26 (i.e. the index finger stall) is referred to as the crotch portion 34.

The baseball glove 20 further comprises a web or backstop 36, secured to the opposing marginal portions of the thumb stall 24, the next adjacent finger stall 26, and the crotch portion 34, with a relatively smooth transition surface between the front plane surface of the thumb stall 24 and the web, the front plane surfaces of the finger stalls and the web, and the front plane surface of the palm portion 22 and the web. The web 36 is generally concave so that its center portion is recessed relative to the thumb stall, finger stalls, and palm portion to form a ballretaining pocket 38 in the web 36. The web 36 may be secured with laces 40 or other suitable means.

The web 36 comprises two outer plies 42 and 44 of a supple, flexible material such as leather, although some other suitable material may be used. An inner resilient ply 46 is sandwiched between the outer plies 42 and 44. This resilient inner ply 46 resiliently resists deformation of the outer plies 42 and 44, thereby absorbing a portion of the impact energy. In the preferred embodiment the inner ply 46 may be made from a resilient nylon woven mesh, for example Style 3546 nylon MICRO MESH (tm) from Game Time Company of North Grafton, Mass. This material has been found to have a weight of 4.75 oz. $\pm 0.3$ with a stretchability of $55 \pm 10\%$ widthwise and $20 \pm 5\%$ lengthwise. Of course some other suitable resilient material could be used. The resilience of inner ply 46 is tempered by the flexible outer plies 42 and 44, which helps prevent the ball from bouncing off the web and out of the glove.

The outer plies 42 and 44 preferably have a plurality of aligned holes or openings 48 therein, which expose portions of the resilient inner ply 46. These openings are sufficiently large, and the portions of the plies 42 and 44 between them sufficiently small, as to allow the plies 42 and 44 to be readily flexible. The flexing of the plies 42 and 44 causes the openings 48 to change shape at least slightly. Lines of stitching 50 preferably extend through the inner and outer plies, around each opening 48. The stitching 50 joins the plies together around each opening, forming a plurality of cells. When a ball impacts the web 36 it deforms the outer plies 42 and 44. During this deformation the opening 48 in the outer plies change shape, this change of shape is resisted by the resilient ply 46 which stretches thereby absorbing some of the impact energy.

In the preferred embodiment, the openings 48 in the outer plies are sized, shaped, and arranged to form a solid, generally circular center 52 with a plurality of radial spokes 54 extending therefrom, and at least one, generally annular cross member 56. In this preferred embodiment there are two generally concentric cross members. The cross members 56 preferably comprise a plurality of curved segments 58 between the spokes 54, these segments are oriented with the concave portions facing radially outwardly from the center 52. The lines of stitching 50 comprise radially extending lines along the spokes 54 and annular lines along the generally annular cross members 56.

In the preferred embodiment the web 36 generally resembles a spider's web, although it should be understood that the appearance could vary substantially without departing from this invention. The openings 48 preferably comprise a first ring of generally trapezoidal-shaped openings 60 surrounding center 52, a second row of generally trapezoidal-shaped openings 62, and a third ring of crescent-shaped openings 64. The spaces between adjacent openings defining the spokes, and the spaces between adjacent rings of openings defining the cross-members.

OPERATION

In operation, when the glove 20 is used to catch a ball, the ball impacts the web 36. This impact causes the outer plies 42 and 44 to flex which causes the openings 48 therein to change shape at least slightly. This deformation of the outer plies absorbs at least some of the impact energy. However, the deformation of the outer plies and in particular the openings 48 is resisted by the resilient inner ply 46, whose deformation absorbs still more of the impact energy. The outer layer tempers the resilience of the ply 44 to reduce the tendency of the ball to bounce off the web 36. Thus the combination of the flexible outer plies 42 and 44 and the resilient inner ply 46 increases impact absorption while minimizing the tendency of the ball to bounce out of the glove. This improved impact absorption makes it easier and more comfortable to catch a ball.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A baseball glove, mitt, or the like having a thumb stall, a finger stall spaced from the thumb stall, and a web secured to and extending between the thumb and fingerstall, the web comprising:

a first ply of a flexible material;

a second ply of a resilient material adjacent the first ply, the second ply being a woven nylon mesh.

2. The device according to claim 1 wherein there are a plurality of openings in the first ply, and further comprising means for securing the first and second plies together in the portions surrounding the openings in the first ply.

3. The device according to claim 2 wherein the means for securing the plies together comprises stitching.

4. A baseball glove, mitt, or the like having a thumb stall, a finger stall spaced from the thumb stall, and a web secured to and extending between the thumb and finger stalls, the web comprising:

two outer plies of a flexible material;

an inner ply of a resilient material sandwiched between the outer plies, the inner plying being a woven nylon mesh.

5. The device according to claim 4 wherein the outer plies have aligned openings therein, exposing the inner ply of resilient material.

6. The device according to claim 5 further comprising means for securing the plies together in the portions surrounding the openings in the outer plies.

7. The device according to claim 6 wherein the means for securing the plies together comprises stitching around the openings in the outer plies.

8. The device according to claim 5 wherein the the openings in the outer plies are arranged in a pattern to define generally radially extending spokes and concentric generally annular cross members.

9. The device according to claim 8 wherein at least some of the openings have a generally trapezoidal shape.

10. The device according to claim 8 further comprising means for securing the plies together in the portions surrounding the openings in the outer plies.

11. The device according to claim 10 wherein the means for securing the plies together comprises stitching around the openings in the outer plies.

12. A baseball glove, mitt, or the like having a thumb stall, a finger stall spaced from the thumb stall, and a web secured to and extending between the thumb and fingerstall, the web comprising:

two outer plies of a flexible material;

an inner ply of a resilient material sandwiched between the outer plies, the inner ply comprising a woven nylon mesh material;

the outer plies having a plurality of aligned openings therein, exposing the inner ply of resilient material, and stitching around the openings in the outer plies, securing the plies together.

13. The device according to claim 12 wherein the openings are arranged to define generally radially extending spokes and concentric generally annular cross members in the web.

14. The device according to claim 13 wherein each of the generally annular cross members formed by the openings in the outer plies is comprised of a plurality of curved segments oriented with their concave sides facing radially outwardly.

15. The device according to claim 14 wherein the openings in the outer plies are arranged to generally resemble a spider's web.

16. The device according to claim 14 wherein the stitching extends along the generally radial spokes and around the concentric generally annular cross members.

17. A baseball glove, mitt, or the like having a thumb stall, a finger stall spaced from the thumb stall, and a web secured to and extending between the thumb and fingerstall, the web comprising:

two outer plies of a flexible material;

an inner ply of a resilient material sandwiched between the outer plies, the inner ply being a woven nylon mesh;

the outer plies having a plurality of aligned openings therein arranged in a pattern to define generally radially extending spokes and concentric, generally annular crossmembers in the outer plies, the openings exposing the inner ply of resilient material, and stitching extending along the generally radial spokes and around the concentric generally annular cross members, securing the plies together.

* * * * *